US005519906A

United States Patent [19]

Fanto-Chan

[11] Patent Number: 5,519,906

[45] Date of Patent: May 28, 1996

[54] FASTENING SUPPORT PILLOW

[76] Inventor: Michelle M. Fanto-Chan, 7882 S. Valentia Way, Englewood, Colo. 80112

[21] Appl. No.: 307,321

[22] Filed: Sep. 16, 1994

[51] Int. Cl.[6] ..... A47G 9/00

[52] U.S. Cl. ..... 5/631; 5/636; 5/655; 5/930

[58] Field of Search ..... 5/636, 631, 640, 5/644, 632, 930, 655; D6/601

[56] References Cited

U.S. PATENT DOCUMENTS

| | | | |
|---|---|---|---|
| 556,088 | 3/1986 | Daly | 5/449 |
| 682,871 | 9/1901 | Hogan et al. | 5/644 |
| 5,339,472 | 8/1994 | Yin | 5/655 |

FOREIGN PATENT DOCUMENTS

| | | | |
|---|---|---|---|
| 20360 | of 1901 | United Kingdom | 5/644 |
| 838455 | 6/1960 | United Kingdom | 297/393 |
| 2198341 | 6/1988 | United Kingdom | 5/636 |

*Primary Examiner*—Alexander Grosz

[57] ABSTRACT

A support pillow that is generally horseshoe or U-shaped with a generally pear shaped cavity in the center and a means of fastening. When used in a horizontal position, the cavity is large enough to fit around the midsection of a normal adult thus allowing for a back support with arm rests, a pregnancy pillow, a floor pillow for reading, sleeping or watching TV, or a nursing pillow. When the fastener is employed, the two tubular arms overlap at the ends forming a closed oval or donut shape. In this position, the pillow can support a small child in a sitting or reclining position. The pillow can also be used in a vertical position supporting both upper and lower back of the user. The pillow is filled with a soft pliable material making it extremely comfortable for all ages and because of the fastener it is easy to carry.

3 Claims, 4 Drawing Sheets

FASTENING SUPPORT PILLOW

BACKGROUND—FIELD OF INVENTION

This invention relates to a pillow, specifically to an improved type of support pillow.

BACKGROUND—DESCRIPTION OF PRIOR ART

Numerous types of pillows have been proposed for supporting either a child or an adult but seldom both. Most pillow designs concentrate on supporting one specific area of the human body and are rigid in shape, not allowing for the same pillow to be used in a variety of positions. These devices fail to accomodate people of different sizes and shapes using the same pillow in many diverse positions.

The present invention is designed for an adult as well as a child. The child or adult can be in a sitting or lying position. When used in a lying position, the person can be on their back or front. The arms of the pillow are adjustable and can be fit snuggly around the person and fastened or left open as desired. Because of the pillow's unique shape and its means of fastening, it can be used as a back support, back support with arm rests, a nursing pillow that completely surrounds the torso of the user, a pregnancy pillow, a floor pillow for reading or watching TV, an infant support pillow and a sleeping pillow. None of the current pillow designs allow for such a wide range of uses for virtually everyone in a family.

Several pillows have been designed to support an adult's head or a child'head while traveling in a vehicle or while sleeping. Specifically, U.S. Pat. No. 4,679,262 (Davis), U.S. Pat. No. 4,285,081 (Price), U.S. Pat. No. 4,788,728 (Lake), U.S. Pat. No. 4,726,085 (Antonio), and U.S. Pat. No. 2,167,622 (Bentivoglio) all talk about support of the head or neck regions. These devices fail to support several parts of the body at once and do not generally have a means of closure or fastening.

U.S. Pat. No. Des. 124,296 (Thompson) discloses an ornamental design of a horseshoe-shaped pillow. It features flat outer and inner walls, as well as flat side walls, with no overlap of the free ends. There is no indication of size, composition, means of closure, or degree of support provided by this ornamental design.

A pillow designed for the support of infants and small children while asleep in a sitting position is disclosed in U.S. Pat. No. 4,726,085 (Antonio). It consists of a thin, U-shaped inset of foam rubber covered with fabric. It is placed about the head so that the neck fits into the U-shaped opening and the free ends extend down the chest of the infant, forming a shelf-like configuration about the shoulders. When the infant nods its head downward, forward, or to either side, the shelf of foam rubber supports the head from further movement. This device again, supports only the head, not any other portion of the infant's body.

An apertured article for use as an infant's head rest is disclosed in U.S. Pat. No. 3,848,281 (Mathews). This toroidal foam rubber cushion is covered in fabric and dimensioned so the ear of the infant will project into the aperture. The cover is made of a flat piece of fabric that lines the aperture and joins to side pieces to form a circle at each side. Again, this device only supports an infant's head region.

A generally tubular-shaped pillow is disclosed in U.S. Pat. No. 5,261,134 (Matthews). The device described is a small polyester filled fabric covered portable pillow used to support an infant or small child up to twenty pounds. The well in the center is described as being no larger than 8 inches. The arms can move apart but normally engage one another. This pillow is useful primarily for an infant in supine position supporting the infant above the floor or other surface immediately beneath the cushion, so that it is the cushion, not the floor, which supports the infant. Because of its dimensions and the fact that it has no means of fastening, it will not envelop the torso of an infant nor an adult. It is rigid in its use and cannot be used by adults and children of different shapes and sizes in diverse positions.

U.S. Pat. No. 4,197,604 (Nakamura) discusses a bi-modal pillow such that the pillow is in an outstretched position in one mode and a closed loop position in another mode with finger-like projection which can interlock. It does not appear to be self-supporting, there is no reference to size or indication of supporting more that one region of the human body at a time.

The retained compressible pillow support disclosed in U.S. Pat. No. 4,236,264 (Britzman) is a closed tubular envelope filled with air. It has no means of fastening and is used to fit about a person's extremity.

U.S. Pat. No. 4,731,890 (Roberts) discloses an L-shaped pillow used by nursing mothers. One arm of the pillow is designed to support the baby while the other arm supports the mother's back. Both of the mother's arms are not supported at the same time, therefore the child would have to be put down and the pillow turned over once the mother is ready to change sides. There is no indication that this pillow could be used for any other support purposes.

OBJECTS AND ADVANTAGES

Accordingly, several objects and advantages of my invention are to provide a support device to persons of all ages and sizes that can be expanded to a greater width or completely closed about the torso by a means of fastening. When the pillow is placed vertically behind an adult in a sitting position, the pillow supports both the upper and lower back. When the pillow is placed horizontally around an adult or child in a sitting position, the pillow supports the lower back as well as providing an arm rest for both arms. When used for nursing, the pillow supports the mother's lower back, both arms, and the child. For infants or children in a sitting position, the pillow not only supports their backs but also helps stabilize and keep them upright in addition to helping them develop the proper muscles for sitting. An adult or child using the pillow in a supine position receives support to the neck and head as well as the back and shoulders. The pillow supports an expectant mother in a prone position placing her protruding stomach in the center hollow. The pillow is designed in such that it may be expanded or contracted, but when outside forces are not applied, it will return to its original shape. The pillow because of its fastener also allows for easy carrying.

Still further objects and advantages will become apparent from a consideration of the ensuing description and accompanying drawings.

REFERENCE NUMERALS

Figure 1:
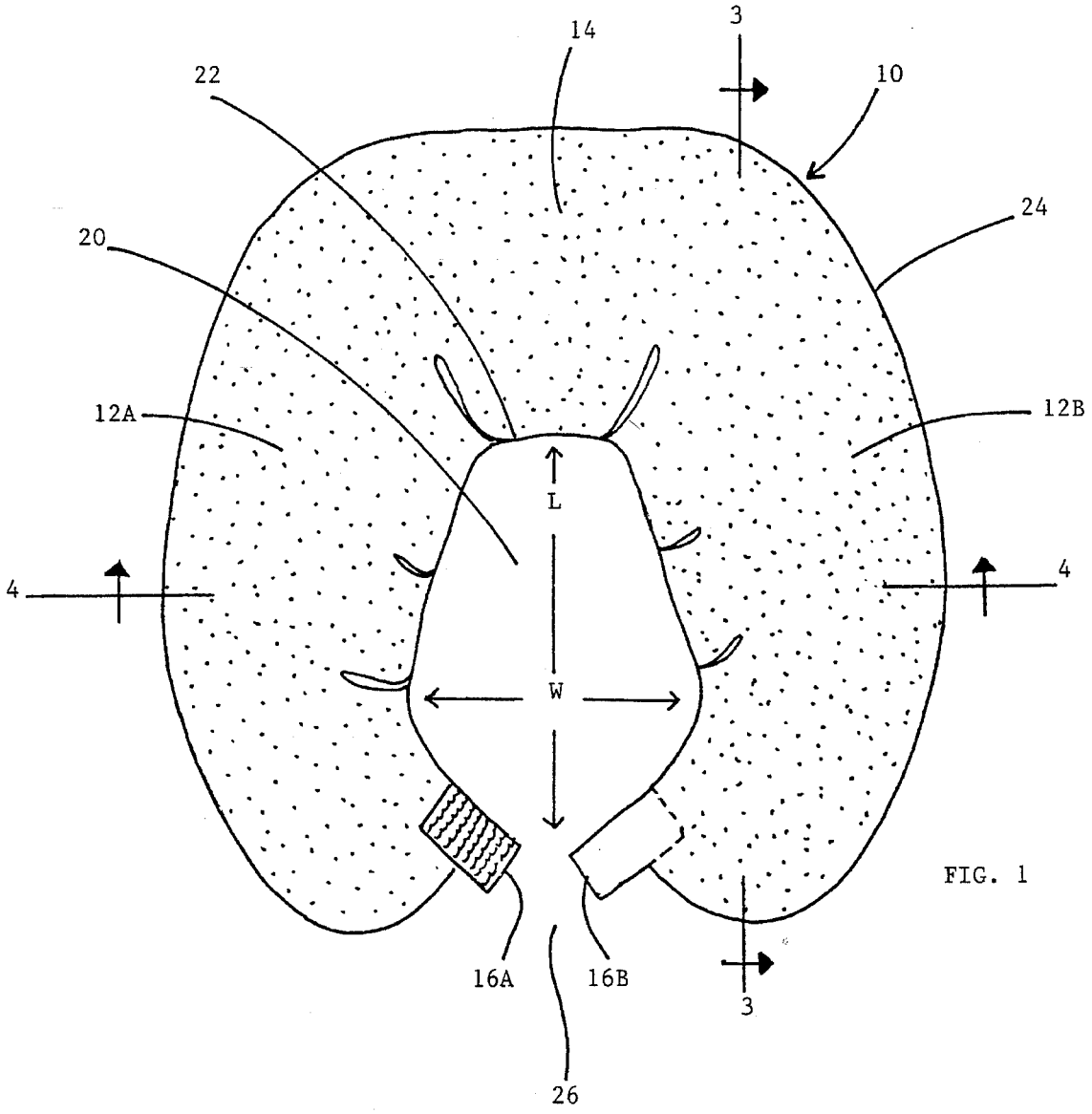
FIG. 1 is a perspective view of my invention in normal position.

10 pillow
12A arms
12B arms
14 back
16A fastener
16B fastener
20 cavity
22 inside edge
24 sheath
26 front
28 stuffing

SUMMARY

A horseshoe or U-shaped support pillow with a cavity in the center large enough to fit around, the midsection of an adult covered with a type of sheath and stuffed with a means of resilient filling.

PREFERRED EMBODIMENT—DESCRIPTION

FIG. 1—Perspective View

FIG. 1 shows the overall perspective view of the present invention. The pillow 10 includes a generally homeshoe shaped or U-shaped cushion. The tubular arms 12A and 12B are connected by the back 14. Arms 12A and 12B contain an open well, aperture, or cavity 20 that has the general shape of a pear. The inside edge 22 of cavity 20 is generally straight and is adjacent to back 14. The front 26 of pillow 10 depicts an opening leading to cavity 20. Cavity 20 may have a width W anywhere from 9 inches to 16 inches or more and a length L anywhere from 9 to 16 inches or more. At the end of each arm 12A and 12B directly opposed from each other is a means of closure or a fastener 16A and 16B. While means such as a button, hook-and-eye, tie or something similar will work, the preferred means of fastening is a hook-and-loop closure such as Velcro. When fasteners 16A and 16B are not engaged, arms 12A and 12B are not in direct contact with each other. Pillow 10 is enclosed in a durable sheath 24 such as fabric, vinyl, or plastic. If plastic or vinyl is used, an additional fabric encasing could be used.

Figure 2:
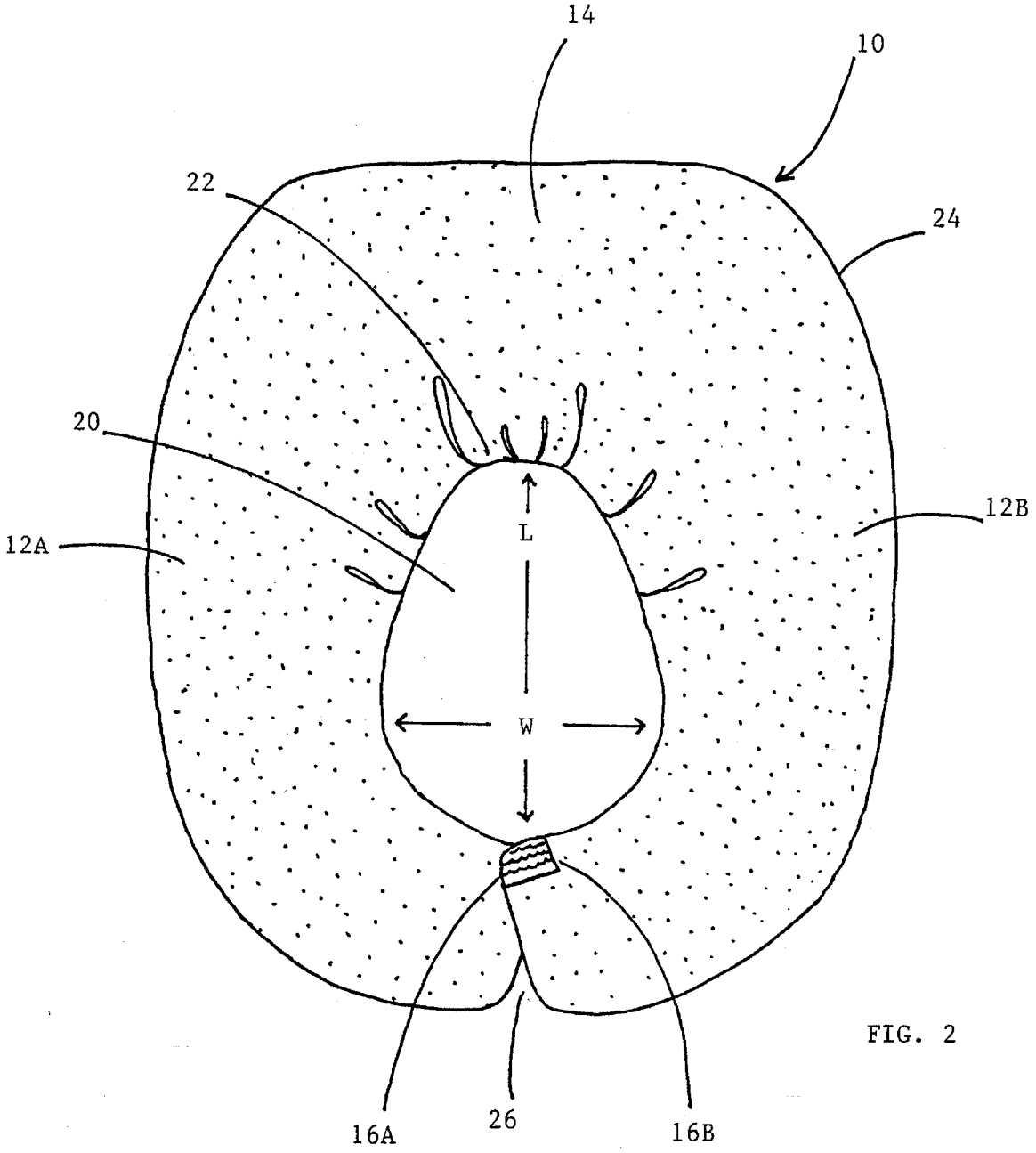
FIG. 2 is a perspective view of my invention with the arms secured in proximity.

FIG. 2—Perspective View with Arms Secured

FIG. 2 is a perspective view of my invention with arms 12A and 12B secured in proximity. Fasteners 16A and 16B are engaged closing cavity 20 from front 26 of pillow 10.

Figure 3:
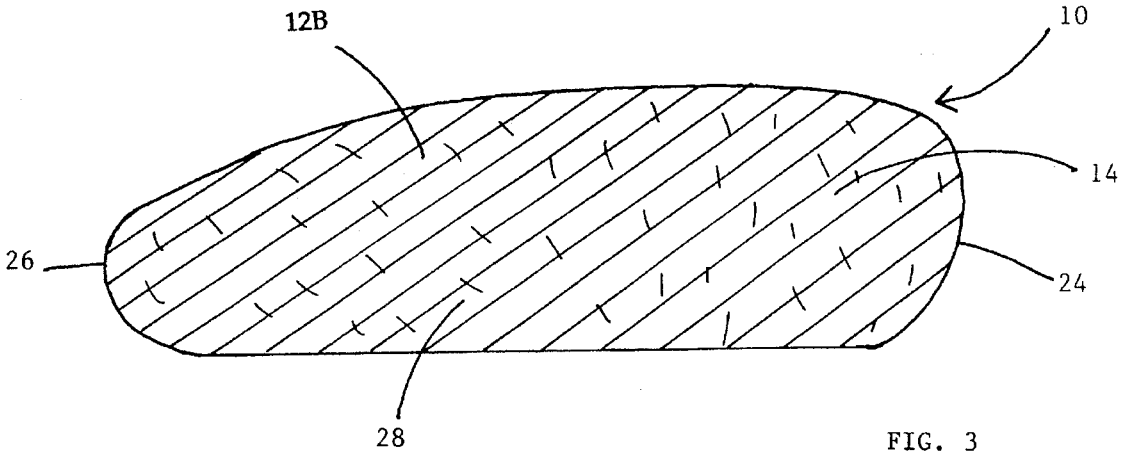
FIG. 3 is a cross-sectional view taken at line 3—3 in FIG. 1.

FIG. 3—Cross-section view along lines 3—3 of FIG. 1

FIG. 3 is a side view of the invention of FIG. 1 taken along a cross section of arm 12B. Back 14 can be somewhat thicker than the ensuing arms 12A and 12B.

Figure 4:
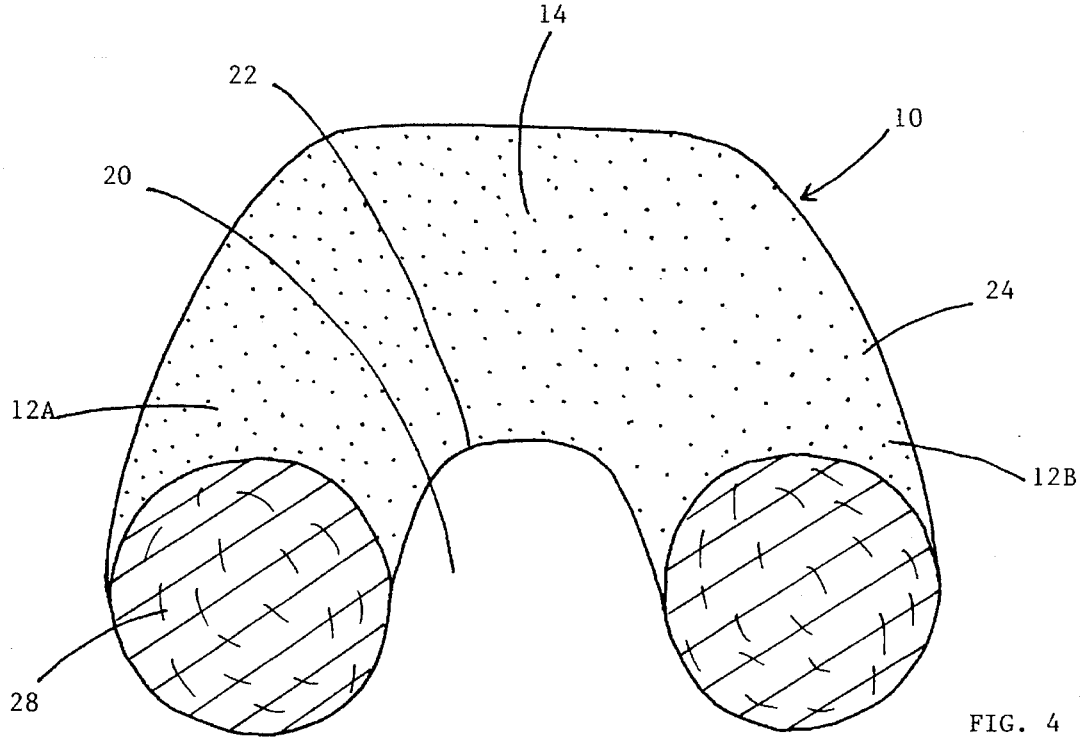
FIG. 4 is a cross-sectional view along the lines of 4—4 of FIG. 1.

FIG. 4—Cross-section view along lines 4—4 of FIG. 1

FIG. 4 is a cross-section view along lines 4—4 of FIG. 1. With reference to FIG. 4, the composition of pillow 10 is shown. Outer sheath 24 consists of a durable substance such as fabric, vinyl, or plastic. Sheath 24 is conveniently made from a pair of identical horseshoe or U-shaped pieces of woven cloth vinyl, or plastic hemmed together around the periphery. The stuffing 28 is a resilient solid compression resistant material such as polyester but could also be air if sheath 24 was such that it formed an air chamber. The density of the packing material is somewhat greater in back 14.

FIG. 5A–5E—Application Examples of my invention

Figure 5A:
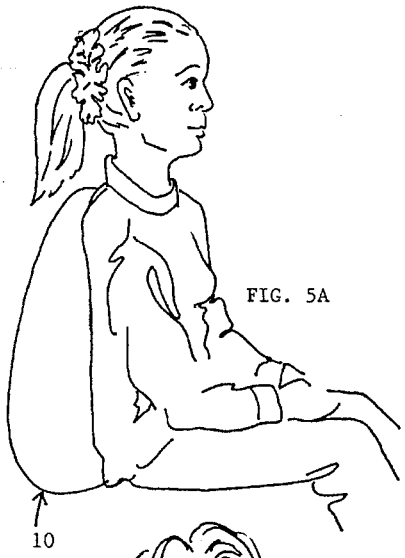
FIG. 5A–E shows application examples of my invention.
Figure 5B:
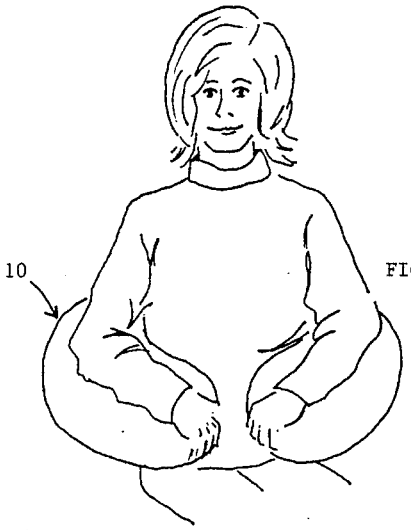
Figure 5C:
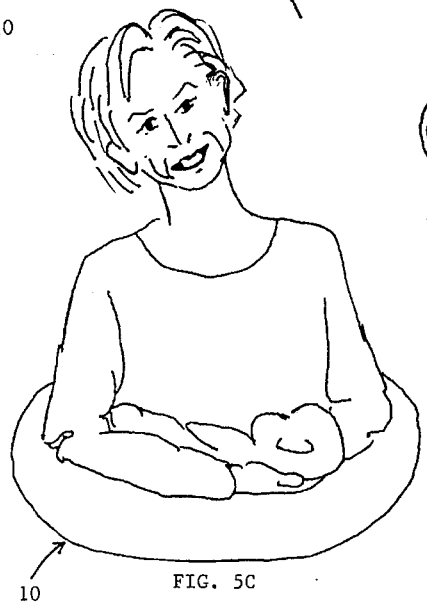
Figure 5D:
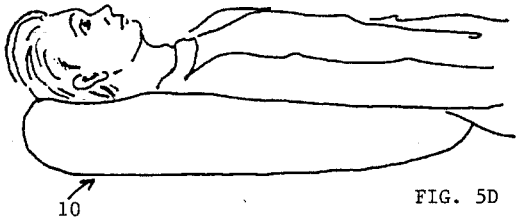
Figure 5E:
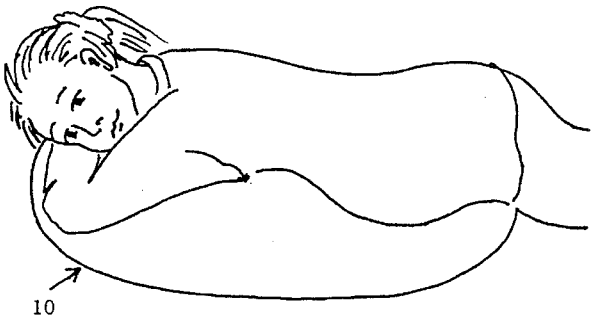

FIG. 5A–5E illustrates some application examples of my invention. FIG. 5A illustrates the invention being used by a person in a sitting position with the pillow behind the person's back. FIG. 5B illustrates the invention being used as a back and arm support while a person is in a sitting position. FIG. 5C illustrates the invention being used as a nursing pillow, FIG. 5D shows the invention being used while a person is in a supine position. FIG. 5E shows how the invention could be used as a maternity pillow.

PREFERRED EMBODIMENT—OPERATION

Support pillow 10 as shown in FIGS. 1–5 has many possible uses. When using pillow 10 in a vertical position while seated as in FIG. 5A, back 14 would be placed at the users lower back. Arms 12A and 12B would extend up the back of the user with fasteners 16A and 16B closed as in FIG. 2 at the base of the neck or upper back. Cavity 20 would be placed in the middle back with length L running parallel to the user's spine. This provides the user with proper support to the lower and upper back and proves to be an extremely comfortable position for someone seated. If less support is needed at the lower back, pillow 10 may be turned so that back 14 is at the base of the neck or upper back.

When using pillow 10 in a horizontal position while the user is seated as is shown in FIG. 5B, back 14 is placed behind the user's back with the user's midsection in cavity 20. Note the pear like shape of cavity 20 is designed to better fit around the human torso and also provides the necessary tension for pillow 10 to keep its shape. Arms 12A and 12B encircle the user providing an arm rest for both arms. For a small child or infant the pillow fits around the child with the floor or surface directly beneath the pillow bearing the weight of the child, fasteners 16A and 16B can be secured as in FIG. 2 providing for more support when learning to sit. In this position, an infant's knees, legs, and feet would all fit in the widest part of the pear like cavity 20. Pillow 10 can also be turned with back 14 in front of the user with the inside edge 22 facing the users stomach to support a child while holding, rocking, or nursing the child as is shown in FIG. 5C with the person's waist at the widest part or cavity 20. Arm 12A and 12B can be closed with fasteners 16A and 16B behind the user to give the user additional support to the lower back thus alleviating back pain often associated with nursing.

A user in a supine position as is illustrated in FIG. 5D places back 14 at the neck and head of the user. Arms 12A and 12B stretch along the users arms and rib cage. Fasteners 16A and 16B are placed at the middle back or waist of the user and can be left open or closed as desired. If the user is an infant or small child, fasteners 16A and 16B may be closed just under the child's feet or knees putting the child in a slight V-position and keeping the child's head from slipping and hitting the floor. This is an extremely comfortable position for watching TV, reading, or sleeping on the floor.

An expectant mother may use pillow 10 as shown in FIG. 5E in a prone position placing her stomach in cavity 20. This allows the user to lie on her stomach without putting undue pressure on the developing fetus.

CONCLUSION, RAMIFICATIONS, AND SCOPE

Accordingly, it can be seen that the described invention allows for a general support pillow for adults as well as children. This diverse pillow can support several parts of the body at the same time. Because of its fastening ability, its shape can change to fit the needs of the user as well as making it an easily portable pillow.

Although the description above contains many specificities, these should not be construed as limiting the scope of the invention but as merely providing illustrations of some of the presently preferred embodiments of this invention. Various other embodiments and ramifications are possible within it's scope. For example, other shapes could be used. The pillow could also be filled with air or foam instead of polyester stuffing. The pillow would not necessarily be symmetrical as shown in all the figures.

Thus the scope of the invention should be determined by the appended claims and their legal equivalents, rather than by the examples given.

What is claimed is:

1. A support device for adults and children which comprises a generally horseshoe shaped pillow formed by two arms curving about a cavity, the cavity having a length dimension in the range of 9 inches to 16 inches, and a width dimension in the range of 9 inches to 16 inches, said arms spaced apart from one another leaving an opening to said cavity, said cavity large enough to fit completely around the midsection of an adult, said pillow comprising a flexible sheath stuffed with a solid resilient filling whereby an adult or child can receive support in a seated, prone, or supine position, said support device, further including means for fastening said arms to each other, thereby making the pillow adjustable.

2. A support device as defined in claim 1 wherein said filling is a polyester filament.

3. A support device for a pregnant or nursing woman which comprises a generally horseshoe shaped pillow formed by two arms curving about a cavity, the cavity having a length dimension in the range of 9 inches to 16 inches, and a width dimension in the range of 9 inches to 16 inches, said arms spaced apart from one another thereby leaving an opening to said cavity that can be enlarged by moving the arms apart from one another thus supporting a pregnant woman's protruding stomach when positioned in the center of the pillow and supporting a nursing woman's back, arms, and baby when placed around the woman's midsection, the support device further including means for fastening said arms to each other, said pillow comprising a flexible sheath stuffed with a solid resilient filling.

* * * * *